US007278527B2

(12) United States Patent
Daout et al.

(10) Patent No.: US 7,278,527 B2
(45) Date of Patent: Oct. 9, 2007

(54) MULTI-DENOMINATIONAL CURRENCY STORE

(75) Inventors: Jerome Daout, Nyon (CH); Juan-Jose Moreno, Le Mont-sur-Lausanne (CH); Christian Bercovitz, Cranves-Sales (FR)

(73) Assignee: MEI, Inc., West Chester, PA (US)

( * ) Notice: Subject to any disclaimer, the term of this patent is extended or adjusted under 35 U.S.C. 154(b) by 642 days.

(21) Appl. No.: 10/221,694

(22) PCT Filed: Mar. 15, 2001

(86) PCT No.: PCT/IB01/00488

§ 371 (c)(1),
(2), (4) Date: Dec. 2, 2002

(87) PCT Pub. No.: WO01/69545

PCT Pub. Date: Sep. 20, 2001

(65) Prior Publication Data

US 2004/0093117 A1 May 13, 2004

(30) Foreign Application Priority Data

Mar. 16, 2000 (GB) ..... 0006407.1

(51) Int. Cl.
*G07F 7/04* (2006.01)

(52) U.S. Cl. ..... 194/206; 194/215; 194/216

(58) Field of Classification Search ..... 194/206, 194/207, 215–217; 209/534; 453/16, 17, 453/2, 49, 40, 57; 221/82, 83
See application file for complete search history.

(56) References Cited

U.S. PATENT DOCUMENTS

| | | | | |
|---|---|---|---|---|
| 4,491,140 A | | 1/1985 | Eglise et al. | |
| 4,669,393 A | | 6/1987 | Wüthrich | |
| 4,836,825 A | * | 6/1989 | Smeets et al. | 453/49 |
| 5,076,441 A | | 12/1991 | Gerlier | |
| 5,499,944 A | | 3/1996 | Weston et al. | |
| 6,006,989 A | | 12/1999 | Ademmer et al. | |
| 6,213,310 B1 | * | 4/2001 | Wennersten et al. | 209/534 |

FOREIGN PATENT DOCUMENTS

| | | | |
|---|---|---|---|
| DE | 3136610 | A1 | 3/1983 |
| EP | 0 367 592 | A2 | 5/1990 |
| EP | 0 520 622 | A2 | 12/1992 |
| EP | 0 907 152 | A2 | 4/1999 |
| GB | 2 326 507 | A | 12/1998 |
| WO | WO94/03874 | A1 | 2/1994 |
| WO | WO98/35324 | A1 | 8/1998 |
| WO | WO 00/16270 | A1 | 3/2000 |

* cited by examiner

*Primary Examiner*—Patrick Mackey
*Assistant Examiner*—Jeffrey A. Shapiro
(74) *Attorney, Agent, or Firm*—Fish & Richardson P.C.

(57) ABSTRACT

The respective proportions of currency items of different denominations in a multi-denominational store are adjusted in accordance with future change requirements for the different denominations. This is achieved by inhibiting the sending of a particular denomination to the store if the number of currency items of that denomination currently contained in the store exceeds a threshold, leaving more room for currency items of other denominations. There is also disclosed a multi-denominational banknote store which stores banknotes individually in radial regions of a drum, and which can rotate to bring each region into registry with an input/output conveyor.

21 Claims, 3 Drawing Sheets

MULTI-DENOMINATIONAL CURRENCY STORE

Figure 1:
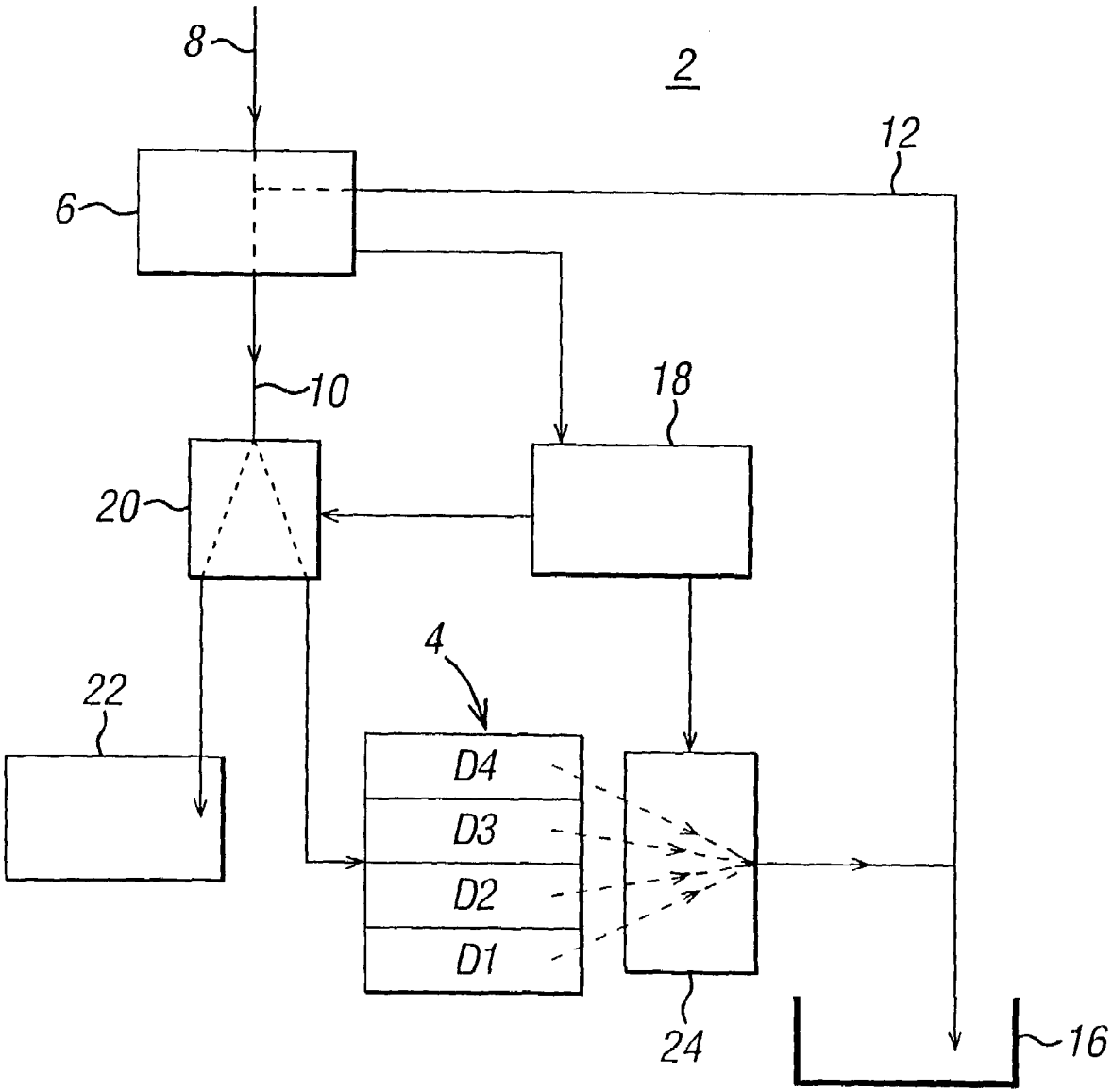

This invention relates to currency stores, and particularly to stores from which currency items can be dispensed and which can be automatically replenished. The invention is particularly applicable to stores for coins or banknotes, used for example in vending machines, which are arranged to receive payment and give change.

Normally, individual stores are required for respective currency denominations. These require a lot of space, some of which is often wasted if there is a relatively low quantity of one or more denominations. For compactness and greater flexibility, it would be desirable to have multiple different denominations stored in the same unit, so that space occupied by one denomination could instead be occupied by a different denomination, but nevertheless to be able to dispense therefrom any selected denomination as change.

A multi-denominational coin store is disclosed in U.S. Pat. No. 4,836,825. This, however, is used only to store coins inserted during a single transaction. At the end of the transaction, the coins are either sent to a cashbox, returned to the user, or sent to individual coin stores for respective denominations.

EP-A-0,290,731 discloses a banknote store capable of receiving banknotes of different denominations, which are stored in succession on a strip wound on a drum. However, the banknotes cannot be individually dispensed as change without additionally discharging the other banknotes from the store.

It would be desirable to have a multi-denominational currency store which can retain currency items received over the course of multiple transactions, so that the items are available as change.

Aspects of the present invention are set out in the accompanying claims.

Some aspects of the invention relate to the control of the replenishment of the multi-denominational store. The store may be a coin store or a banknote store; for example, the store may be a coin store as disclosed in U.S. Pat. No. 4,836,825, except that it is used to store coins from multiple transactions and thereafter dispense them as change, thus obviating the need for additional, separate coin stores for respective denominations. The capacity of the coin store would preferably be greater than that disclosed in U.S. Pat. No. 4,836,825.

In accordance with one aspect of the invention, the respective proportions of currency items of different denominations in a multi-dimentional store are adjusted in accordance with future change requirements for the different denominations, inhibiting the sending of a particular denomination to the store if the number of currency items of that denomination currently contained in the store exceeds a threshold, leaving more room for currency items of other denominations.

In accordance with a further aspect of the invention, there is provided a method of controlling the supply of currency items to a multi-denominational currency store (in which a given storage space can be occupied by any of a plurality of denominations), the store being arranged to store currency items for selective dispensing as change during subsequent transactions, the method comprising determining whether a received currency item should be sent to the store in dependence upon the denomination of the currency item and the quantity of currency items of at least one denomination currently stored in the coin store.

Using this technique, it is possible to control the relative quantities of the different denominations stored in the multi-denominational store. It is thus possible to arrange for the relative quantities to be matched to the expected requirements for the dispensing of change. Any currency items not sent to the store are preferably instead delivered to a cashbox (from which they cannot be dispensed as change).

The decision as to whether any particular currency item should be delivered to the store may depend upon the quantity of items of the same denomination which are currently already stored in the store. For example, the decision may be based on whether not the currently-stored quantity exceeds a predetermined threshold, this threshold preferably being capable of being different for different denominations. The respective thresholds could be fixed in advance in accordance with the expected change requirements. However, in the preferred embodiment, the thresholds are automatically adjusted in accordance with past requirements for change, thereby to make them more likely to be appropriate for future requirements. In the preferred embodiment, the threshold for each denomination is adjusted in accordance with the past requirements for change of at least that denomination, and preferably all stored denominations.

Other aspects of the invention relate to the structure of a multi-denominational banknote store. In accordance with a further aspect of the invention, such a store comprises a plurality of individual storage regions, each provided with a respective feeding means for feeding a banknote into and out of the region, the feeding means being carried by support means which can be rotated to bring any selected feeding means into registry with a device for conveying banknotes from the store, whereby one or more banknotes of selected denominations can be retrieved from the store by appropriate rotation of the support means and operation of one or more of the feeding means. In this way, it is possible to remove selected denominations from the store while still storing the remainder.

The store may be generally drum-shaped, and the storage regions may be arranged to extend radially towards the axis of the drum, with the regions arranged in succession around the drum periphery. The device which is used for conveying banknotes away from the store may additionally be used for conveying banknotes to the store; alternatively, there could be a separate input conveyor disposed at a different position around the circumference of the drum.

Preferably, a control system keeps a record of the positions at which respective banknotes are stored, and the denominations stored at each location. The control means can be arranged to add banknotes to those locations which have been vacated by dispensed banknotes.

Figure 2:
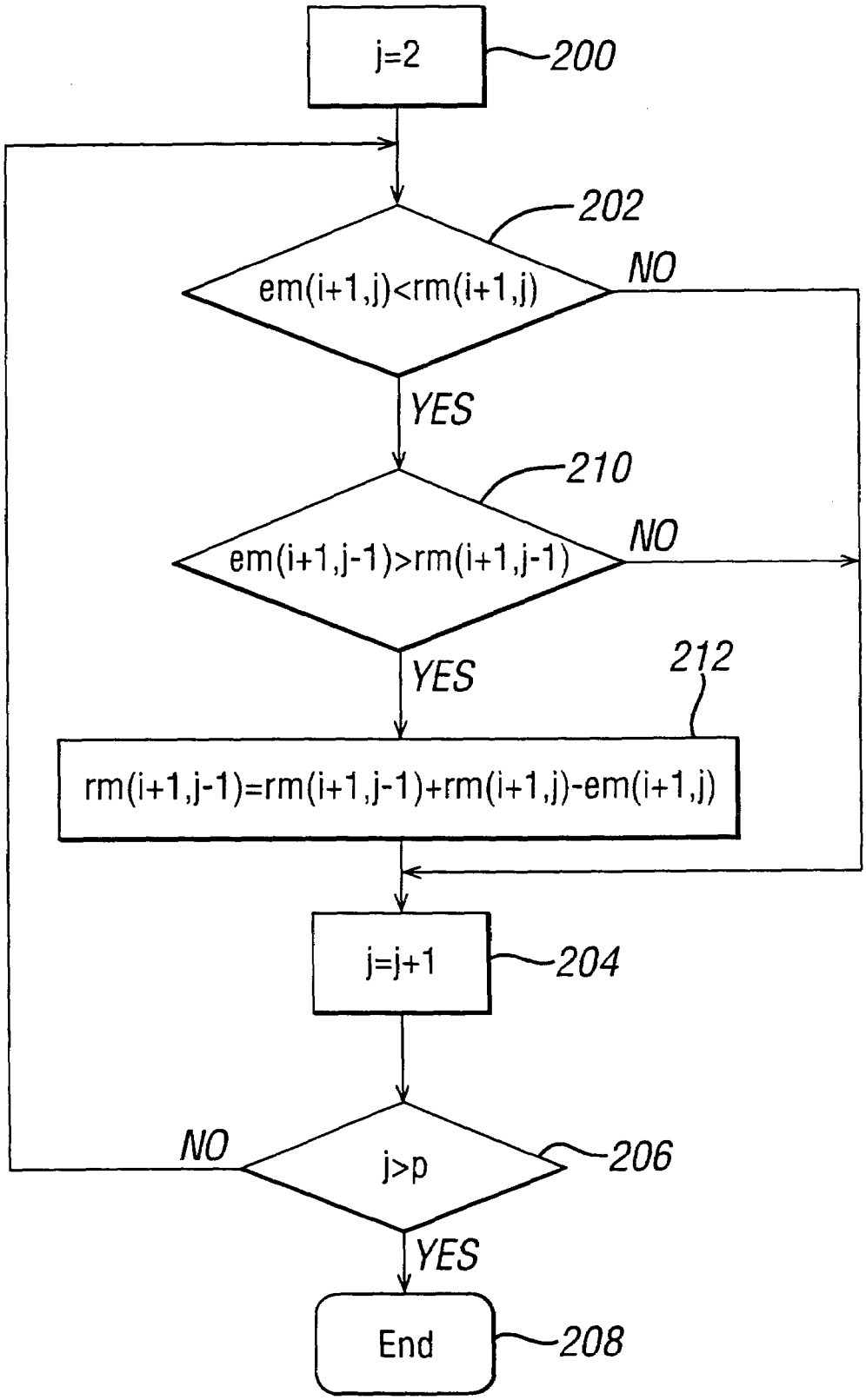
Figure 3:
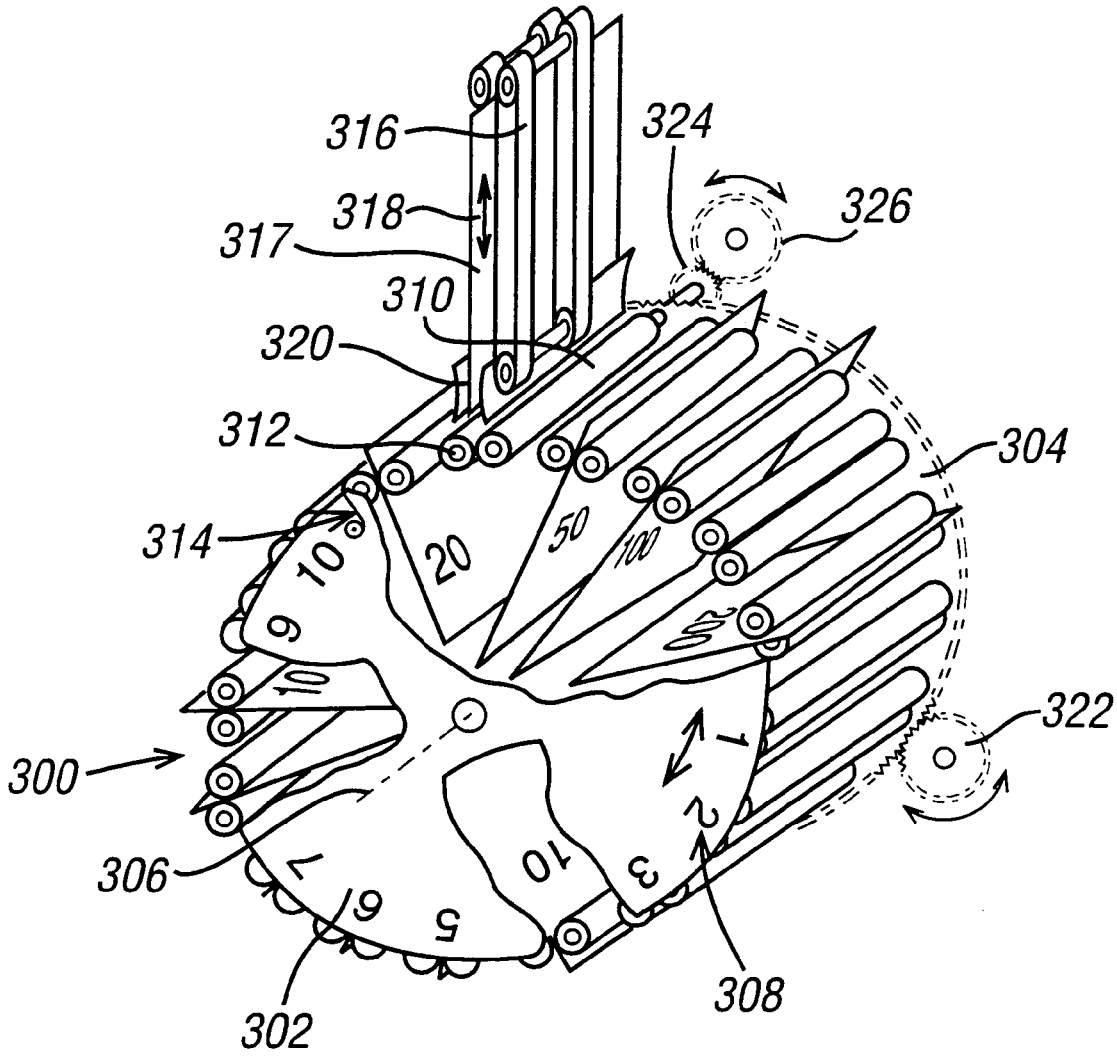

Arrangements according to the invention will now be described by way of example with reference to the accompanying drawings, in which:

FIG. 1 schematically illustrates a cash handling system comprising a multi-denominational currency store, together with mechanisms for controlling dispensing and replenishment thereof, in accordance with the invention;

FIG. 2 is a flowchart to indicate how threshold levels for use in controlling replenishment can be modified; and FIG. 3 schematically shows a multi-denominational banknote store in accordance with the invention.

Referring to FIG. 1, this shows a currency handling system 2, including a multi-denominational store 4. This arrangement will be described in the context of a banknote handling system, but is equally applicable to systems for handling coins, or a combination of banknotes and coins.

The system 2 is housed in, for example, a vending machine (not shown) capable of vending multiple types of products at different prices.

In the illustrated example, the multi-denominational store 4 can store four different denominations of banknotes, D1, D2, D3 and D4. The important feature about a multi-denominational store is that, although its total capacity may be fixed, the capacity for each individual denomination can be varied. Thus, if necessary, a relatively large quantity of banknotes of denomination D1 can be stored in the store 4, so long as the quantities of the other denominations are reduced so that the overall capacity is not exceeded.

In the schematically-illustrated system of FIG. 1, a banknote validator 6 receives banknotes from an input path 8. Banknotes deemed to be valid and acceptable are transferred to an accept path 10. Other banknotes are delivered via a reject path 12 to an outlet 16. If a banknote is deemed acceptable, a signal representing the denomination is sent by the validator 6 to a controller 18.

The accept path 10 leads to a gate 20. The controller 18 controls the gate 20 so that an accepted banknote is delivered either to a cashbox 22 or to the multi-denominational store 4. The arrangement may be such that only certain denominations (D1, D2, D3 and D4) are sent to the multi-denominational store 4, from which they can subsequently be dispensed as change, whereas other denominations are never sent to the banknote store 4, but instead are delivered to the cashbox 22.

A dispenser 24 is controlled by the controller 18, and can dispense a banknote of any one of the selected denominations D1, D2, D3 and D4 so that it is refunded to the tray 16 (or sent to an escrow (not shown) so that it can be collected with other notes to be delivered as a stack to the tray 16). Obviously, this operation can be repeated so that the apparatus can dispense change of any desired total amount, formed by combinations of denominations D1 to D4.

The desired total amount to be dispensed can be calculated by the vending machine in which the apparatus 2 is housed, and the signal representing this amount be sent to the controller 18, so that the controller can calculate how many banknotes of the respective denominations should be dispensed, so that the total value dispensed is equal to the desired amount. Alternatively, the vending machine itself could perform this calculation, and issue to the controller 18 instructions as to which denomination should be dispensed. In the latter case, the controller 18 is preferably capable of sending to the vending machine signals representing whether or not individual denominations are available for dispensing, and preferably how many currency items of each denomination are available.

Various techniques are known in the prior art for determining the combination of denominations to be dispensed. Preferably, the change algorithm is capable of selecting between different combinations, each of which sums to the desired total amount. One typical way of achieving this, referred to as the "least number" method, involves using as many higher-denomination currency items as possible, so that the total number of dispensed currency items is minimised. This is intended to maximise the number of currency items retained in the store so that change remains available for the maximum number of transactions. The change algorithm used in the present embodiment may use such a technique. Preferably, however, the change calculating algorithm is operable to take into account the number of currency items of respective denominations which are currently stored, so that if certain denominations are available in plentiful quantities, they are dispensed in preference to other denominations. Such an arrangement is disclosed in EP-A-0 729 624, the contents of which are incorporated herein by reference.

Although FIG. 1 suggests that banknotes of each of the denominations are kept together within the store, this is not essential, and indeed the physical positions of the different denominations may be intermingled, so long as the controller 18 is able to cause a selected denomination to be dispensed. The controller 18 keeps track of the number of banknotes of the respective denominations within the store 4, by counting the banknotes which have been delivered to the store via the gate 20 and/or by having one or more sensors for sensing the quantity of the different denominations in the store.

Preferably, the store 4 is manually replenished by a serviceman when the apparatus is serviced. A serviceman ensures that the store 4 contains sufficient banknotes to cope with the expected requirements for change for a number of transactions. The controller 18 can also display the number of notes of respective denominations required for replenishing by the serviceman. During the course of using the vending machine in which the apparatus 2 is housed, various banknotes will be dispensed from, and added to, those in the banknote store 4. At any given time, therefore, the banknote store 4 will contain banknotes inserted during a number of previous transactions. It would be desirable for the apparatus to be arranged so that the automatic replenishment of the banknote store 4 delivers to this store banknotes of the appropriate denominations, in the appropriate quantities, to match as far as possible the requirements for change, so that manual replenishment by a serviceman is not needed, or at least is not needed frequently.

In the illustrated embodiment, this is achieved by virtue of the fact that the controller 18 can, by operating the gate 20, prevent banknotes of a particular denomination from being sent to the banknote store 4, even if there is sufficient capacity in the banknote store 4 to accommodate such banknotes, and even if such banknotes are of an appropriate denomination, i.e. D1, D2, D3 or D4, for delivery to the store. The banknotes are instead sent to the cashbox 22. The consequence of this is that the multi-denominational store 4 will not be filled to capacity by banknotes of this particular denomination, so that sufficient room is left for banknotes of different ones of the denomination D1, D2, D3 and D4 to be subsequently sent to the store 4 after having been received by the validator 8. Therefore, the controller 18 can control the relative quantities of the different denominations so that a desired distribution, which is likely to be suitable for change dispensing operations, is stored.

Assuming that it is desired that the multi-denominational store 4 be arranged to store p denominations (1 to p), then the controller 18 preferably has a memory storing p threshold values, R(1) to R(p), one for each denomination. On receipt of a currency item of denomination j, then the controller 18 controls the gate 20 so as to send the currency item to the store 4 only if N (j) is less than R(j), where N(j) is the currently stored number of currency items of denomination j.

The apparatus 2 may be provided with a means allowing the setting of the values R(1) to R(p), such as a keyboard, a port or a terminal, or means permitting remote access by a central computer.

In the preferred embodiment, however, the controller 18 is capable of calculating the threshold levels and, more preferably, altering the threshold levels in accordance with expected change requirements. The system may nevertheless have means to allow an external alteration of the threshold values, for the purposes of initialisation, or subsequent manual adjustment.

A preferred technique for adjusting the threshold levels will now be described. In this technique, the threshold levels are represented by R(i,j), wherein j represents the denomination and i represents the transaction during which the threshold is effective.

In the following, it is assumed that

MC is the maximum capacity of the store 4;

e(i,j) is the number of bills of denomination j introduced at transaction i;

em(i,j) is the mean value of e(i,j) over time up to and including transaction i;

r(i,j) is the number of bills of denomination j given back (as change) during transaction i;

rm(i,j) is the mean value of r(i,j) over time up to and including transaction i;

q is a weight that can be defined according to suit particular requirements.

This factor determines the speed at which the distribution of stored currency items is modified to approach a desired distribution.

In order to make most use of the capacity of the store 4, the goal is that:

$$\sum_{j=1}^{p} R(i, j) = MC$$

i.e. that the store 4 is filled when all the denominations are present in their threshold quantities.

In accordance with the preferred embodiment, after a transaction (i+1), the following calculations are performed by controller 18 for all denominations j=1 to p:

$$em(i+1, j) = \frac{q * em(i, j) + e(i+1, j)}{q+1}$$

$$rm(i+1, j) = \frac{q * rm(i, j) + r(i+1, j)}{q+1}$$

Thus, it can be seen that the parameters em(i,d), rm(i,j) are weighted rolling averages.

Thereafter the controller 18 performs the steps shown in the flowchart of FIG. 2.

Assuming that denominations 1 to p are in order of increasing value, an index j is set equal to 2, representing the second lowest denomination, at step 200.

At step 202, the controller 18 determines whether the average number of received bills of denomination j is less than the average number of dispensed bills (em(i+1,j)<rm(i+1,j)). If the average number of received bills is equal to or greater than the average number of dispensed bills, then it is deemed that there is no problem with ensuring that bills of denomination j are replenished in sufficient quantity. The program then proceeds to step 204, wherein j is set equal to j+1, representing the next-higher denomination.

At step 206, it is determined whether j exceeds the maximum number p. If not, the program loops back to step 202; otherwise the program ends at step 208.

If at step 202 it is determined that the average number of received bills of denomination j is less than the average number of dispensed bills of denomination j, this represents a potential problem, and the program proceeds to step 210.

At step 210, the controller determines whether the average number of received bills for denomination j−1 exceeds the average number of dispensed bills of denomination j−1 (em(i+1,j−1)>rm(i+1,j−1)). If the average number of received bills exceeds the average number of dispensed bills, this means that the apparatus is receiving more bills of denomination j−1 than required for dispensing. In this case, the program proceeds to step 212. At this step, the controller 18 modifies the value rm(i+1,j−1) representing the average number of dispensed bills of denomination j−1, by adding to it the difference between the average number of dispensed bills of denomination j and the average number of received bills of denomination j (rm(i+1,j−1)=rm(i+1,j−1)+rm(i+1,j)−em(i+1,j)). In other words, the controller 18 calculates a quantity representing the rate at which the quantity of bills of denomination j in the store 4 is decreasing, and then adds this quantity to the calculated average number of dispensed bills of denomination j−1, in order to indicate that the average number of dispensed bills of denomination j−1 was higher than the actual true value.

The result of this is to suggest that the requirement for bills of denomination j−1 is higher than the actual requirement was in the past. As a result, the threshold for the denomination j−1 is increased, so more bills of denomination j−1 are sent to the store 4. Accordingly, this will allow change to be dispensed using the smaller denomination, j−1, rather than the larger denomination j, of which there is insufficient supply.

It is to be noted that this modification only occurs if there is an adequate supply of bills of denomination j−1, as determined at step 210. If, at step 210, the controller 18 determines that the average number of received bills is not greater than the average number of dispensed bills of denomination j−1, the program instead proceeds straight to step 204, to increment the index j.

After the algorithm represented by FIG. 2 is performed, the controller 18 then recalculates the thresholds for all the denominations j=1 to p using the following formula:

$$R(i+2, j) = Int\left[rm(i+1, j) * \frac{MC}{\sum_{n=1}^{p} rm(i+1, n)}\right]$$

The thresholds R(i+2,j) are then applied during the next transaction, i+2.

The result of this procedure is that, over the course of a number of transactions, the proportions of the different denominations in the store 4 will tend to correspond to the average proportions of the denominations required for change. However, this tendency is modified (according to step 210) if one denomination is in short supply and the next-lower denomination is in plentiful supply, to increase the number of lower-denomination banknotes which can therefore be dispensed as change in preference to the higher denomination. This diminishes the requirement for the higher denomination banknotes.

At some stage, assuming the population distribution of received and dispensed banknotes remains approximately constant, the store 4 will optimise the relative quantities of the different denominations so as to reduce the chances of insufficient change being available. Furthermore, if either of the population distributions changes, possibly as a result of a change in the prices of vended products, the distribution of denominations in the store 4 will automatically adapt to this.

There are presented below two example situations, in which it is assumed that the store 4 is arranged to store two denominations of values 10 and 20 (in arbitrary units). It is assumed that:

- MC=100 (maximum capacity);
- r(i+1,1)=3, r(i+1,2)=3, which represent the change given at the last transaction (i+1);
- rm(i,1)=3, rm(i,2)=2, which represent the proportions formerly calculated to be needed for each denomination;
- q=5, this weight being chosen arbitrary low to cause a quick adaptation;
- at the beginning the store 4 contains 60 of the 10's and 40 of the 20's (but according to the last transaction it seems desirable to have instead 50 of the 10's and 50 of the 20's).

Case1:

First, assume that both denominations have been received in adequate quantities, in particular:

$$em(i+1,1)=5$$

$$em(i+1,2)=5$$

Then:

$$rm(i+1,1)=\frac{5*3+3}{5+1}=3$$

$$rm(i+1,2)=\frac{5*2+3}{5+1}=2.17$$

$$R(i+2,1)=Int\left(3*\frac{100}{3+2.17}\right)=58 \text{ (instead of 60 before)}$$

$$R(i+2,2)=Int\left(2.17*\frac{100}{3+2.17}\right)=41 \text{ (instead of 40 before)}$$

Thus, in this case, the thresholds are changed so that the relative proportions of stored denominations will change in the desired manner.

Case 2:

Now, assume that relatively few 20's are received, in particular:

$$em(i+1,1)=5$$

$$em(i+1,2)=1$$

Then:

$$rm(i+1,1)=\frac{5*3+3}{5+1}=3$$

$$rm(i+1,2)=\frac{5*2+3}{5+1}=2.17$$

$$em(i+1,1)>rm(i+1,1)\Rightarrow rm(i+1,1)=3$$

$$em(i+1,2)<rm(i+1,2)\Rightarrow rm(i+1,2)=2.17$$

rm(i+1,1) is therefore replaced by $$rm(i+1,1)=rm(i+1,1)+rm(i+1,2)-em(i+1,2)=3+2.17-1=4.17$$

$$R(i+1,1)=Int\left(4.17*\frac{100}{4.17+2.17}\right)=65 \text{ (instead of 60 before)}$$

$$R(i+1,2)=Int\left(2.17*\frac{100}{4.17+2.17}\right)=34 \text{ (instead of 40 before)}$$

In this case, the change in the threshold levels will tend to cause the proportions of the denominations to change away from the desired proportions as indicated by previous change dispensing operations. However, the result of this is that the change algorithm will tend to dispense 10's, because of the large number thereof, whereas in the past 20's would be dispensed more often. Thus, the proportions will change to match the future expected requirements, and also the expected availability of denominations for replenishment.

Many modifications to the above-described techniques are possible. For example, in steps 202 and 210 the rolling averages of received banknotes are compared with rolling averages of dispensed banknotes. Instead, the controller 18 can simply determine the rate at which the number of stored banknotes of respective denominations increases or decreases; for example, the controller may calculate for each denomination the change in the stored quantities over a predetermined number of transactions.

The above techniques disregard the relative values of the denominations, but these could instead be taken into account. For example, the calculation performed at step 212 could be arranged to modify the value rm(i+1,j−1) by a factor which is proportional to (rm(i+1,j)−em(i+1,j)), the constant of proportionality being dependent upon the relative values of the denominations j,j−1.

In the present embodiment, the controller 18 determines the desired relative proportions of the different denominations in the store 4. However, this determination can instead be carried out as part of the change-calculating algorithm. Thus, the change-calculating algorithm can take into account various factors, such as the relationship between prices and the values of respective denominations, to determine which denominations are most likely to be required for change, and this information can be used in adjusting the relative proportions of the different denominations in the store 4. Indeed, the change algorithm could be used to decide which denominations should be sent to the store, and which should be sent to the cashbox.

Various other factors can also be taken into account either in setting the initial threshold levels or in adjusting those levels. Examples of various factors which may be used are given in WO-A-94/03874, the contents of which are incorporated herein by reference. One example is data indicative of the relative population levels of respective currency denominations in the area in which the apparatus is to be used.

FIG. 3 shows a multi-denominational banknote store 300, which could constitute the store 4 of FIG. 1, in accordance with the present invention. The store 300 is generally drum-shaped, and comprises a pair of flanges 302 and 304 which are generally circular in shape and are mounted for rotation about a common axis 306. The near flange 302, shown in the drawing, is shown partially broken away to illustrate the interior of the store 300.

The store 300 has a number of storage regions each of which extends radially inwardly from the periphery of the drum, at different positions around the circumference, between the flanges 302 and 304. The storage positions are represented by indicia on the flange 302, as indicated at 308. Each storage region has associated therewith a feeding means in the form of a pair of rollers (e.g. 310 and 312), which can be used for feeding a banknote into or out of the respective storage region. Each roller is mounted at one end on the flange 302 and at the other end on the flange 304. Each pair of rollers comprises a driving roller, such as that shown at 310, having a high coefficient of friction, and a pressure roller such as that shown at 312 which is biased towards the driving roller by means of one or more springs (one of which is shown at 314) fixed to one or both of the flanges 302 and 304.

An input-output belt conveyor 316 is arranged for delivering banknotes to and retrieving banknotes from the store 300, and moves notes such as that shown at 317 in the generally radial direction indicated by arrow 318 to and from a guide 320 mounted at a particular position around the periphery of the store 300.

The flange 304 has, around its periphery, geared teeth which mesh with a cog 322, which is driven by means of stepper motor (not shown) so as to rotate the store 300 about the axis 306. By this means, any selected feeding means formed by a pair of rollers 310, 312, can be brought into registry with the guide 320.

Each of the driving rollers 310 is provided with a cog, only one of which is shown at 324, at the end adjacent the flange 304. As the store 300 is rotated, these cogs are brought into and out of meshing engagement with a driving cog 326 linked to a small DC motor, the arrangement being such that only the gear 324 of the driving roller 310 associated with the feeding means in registry with the guide 320 is in engagement with the cog 326.

The operation of the store 300 is as follows. Whenever a banknote is to be stored, it is fed by the conveyor 316 to the guide 320. The cog 322 is operated to rotate the store 300 until the feeding means 310, 312 of a vacant storage region is in registry with the guide 320. At that point, the cog 326 is rotated in a clockwise direction in order to draw the banknote 317 into the storage region. At the end of this operation the outer end of the banknote is held between the rollers 310, 312. Further banknotes, of possibly differing denominations, can be correspondingly fed to other storage regions.

A controller keeps track of the denominations of the banknotes in the respective storage regions, and uses this information in operating the cog 322 to ensure that bills are only fed into vacant storage regions.

When one or more banknotes is to be dispensed, the cog 322 is driven so as to bring a storage region containing a bill of an appropriate denomination into registry with the guide 320, and the cog 326 is driven in an anti-clockwise direction as the conveyor 318 is operated to draw the banknote out of the store. Several bills of selected denominations can be removed from the store in this way and delivered either directly or after being collected into a stack to a customer.

Although the conveyor 316 in the present embodiment is arranged to convey bills both to and from the store 300, if desired there could be separate devices for performing these respective functions, located at different positions around the periphery of the store 300.

In this embodiment, the interior of the drum is unpartitioned so that the storage regions are not separated from each other. However, dividers could be provided if desired.

The invention claimed is:

1. A method of controlling the replenishment of a currency store which can be filled to capacity in variable proportions of currency items of different denominations and which can dispense currency items of selected denominations received during multiple transactions, the method comprising determining whether or not to send a currency item to an available location in the store in dependence upon the denomination of that currency item and the level of at least one denomination currently stored in the store, wherein a currency item of a different denomination can instead be subsequently sent to said location and the proportions of different denominations in the store can thus be controlled.

2. A method as claimed in claim 1, wherein the decision as to whether to send a currency item to the store is dependent upon how many currency items of the same denomination are currently stored in the store.

3. A method as claimed in claim 2, wherein, for each stored denomination, the decision as to whether to send a currency item of that denomination to the store is dependent upon whether the number of stored currency items of that denomination is less than a predetermined threshold.

4. A method as claimed in claim 3, wherein there are respective thresholds for the different denominations.

5. A method as claimed in claim 4, including the step of setting the respective thresholds to predetermined levels.

6. A method as claimed in claim 1, further comprising assessing the need to adjust the relative proportions of the stored denominations to improve the availability of currency items required for dispensing, and in response thereto automatically adjusting a criterion used to determine whether or not to send a currency item of a selected denomination to the store.

7. A method as claimed in claim 6, wherein the criterion is modified by adjusting the threshold level for the respective denomination.

8. A method as claimed in claim 6, including the step of determining a parameter indicative of whether a denomination is likely to be required for dispensing on the basis of the number of items of that denomination which have been dispensed in earlier transactions.

9. A method as claimed in claim 8, including the step of maintaining a rolling average of currency items dispensed during earlier transactions.

10. A method as claimed in claim 6, including the step of adjusting the criterion in response to determining that currency items of a particular denomination are more likely to be dispensed than received by the store.

11. A method as claimed in claim 10, including the step of comparing a first value representative of the number of currency items of a particular denomination received during earlier transactions with a second value representative of the number of currency items of that denomination dispensed during earlier transactions.

12. A method as claimed in claim 10, wherein the criterion is adjusted so as to increase the proportion of stored currency items of a denomination lower than said particular denomination.

13. A method of controlling a currency store, comprising:

controlling the replenishment of the store by determining whether or not to send a currency item to an available location in the store in dependence upon the denomination of that currency item and the level of at least one denomination currently in the store wherein a currency item of a different denomination can instead be subsequently sent to said location and the proportions of different denominations in the store can thus be controlled; and controlling the dispensing of currency items therefrom by determining a desired total amount to be dispensed, calculating how many currency items of respective denominations should be dispensed to obtain said total amount, and operating a dispenser so as to dispense the calculated amounts of currency items.

14. A method as claimed in claim 13, wherein the calculation of how many currency items of respective denominations should be dispensed is capable of determining more than one combination of currency items available for dispensing, each of which combination sums to said total amount, and is operable to select a combination on the basis of the number of currently-stored items of respective denominations.

15. Currency storage apparatus comprising a multi-denominational currency store and control means operable to control the store using a method as claimed in claim 1.

16. Apparatus as claimed in claim 15, suitable for storing coins.

17. Apparatus as claimed in claim 15, suitable for storing banknotes.

18. A vending machine containing currency storage apparatus comprising a multi-denominational currency store and control means operable to control the store using a method as claimed in claim 1.

19. A multi-denominational banknote store, the store comprising a plurality of individual storage regions each provided with a respective feeding means for feeding a banknote into and out of the region, the feeding means being carried by support means which can be rotated to bring any selected feeding means into registry with a device for conveying banknotes from or to the store, whereby one or more banknotes of selected denominations can be retrieved from or conveyed to the store by appropriate rotation of the support means and operation of one or more of the feeding means, said retrieval or conveyance being determined by control means, said control means being configured to operate the banknote store in accordance with the method of claim 1.

20. A store as claimed in claim 19, including drive means which can operatively engage each feeding means when that feeding means is in registry with the conveying means so as to operate the feeding means.

21. The method as claimed in claim 1 including keeping a record of positions at which respective banknotes are stored and of denominations stored at each location.

* * * * *